US009440238B2

(12) United States Patent
Pilch et al.

(10) Patent No.: US 9,440,238 B2
(45) Date of Patent: Sep. 13, 2016

(54) SHREDDER WITH MEDIA DETECTOR

(71) Applicant: Staples The Office Superstore, LLC, Framingham, MA (US)

(72) Inventors: Alan C. Pilch, Hudson, OH (US); Mark E. Reindle, Sagamore Hills, OH (US)

(73) Assignee: Staples The Office Superstore, LLC, Framingham, MA (US)

( * ) Notice: Subject to any disclaimer, the term of this patent is extended or adjusted under 35 U.S.C. 154(b) by 408 days.

(21) Appl. No.: 13/895,763

(22) Filed: May 16, 2013

(65) Prior Publication Data

US 2013/0306766 A1 Nov. 21, 2013

Related U.S. Application Data

(60) Provisional application No. 61/647,859, filed on May 16, 2012.

(51) Int. Cl.
*B02C 25/00* (2006.01)
*B02C 18/00* (2006.01)

(52) U.S. Cl.
CPC ..... *B02C 25/00* (2013.01); *B02C 18/0007* (2013.01)

(58) Field of Classification Search
CPC ..... B02C 25/00; B02C 18/0007
USPC ..... 241/34, 236, 100
See application file for complete search history.

(56) References Cited

U.S. PATENT DOCUMENTS

| | | | | |
|---|---|---|---|---|
| 7,661,613 | B1 * | 2/2010 | Pan | B02C 18/0007 241/100 |
| 7,823,815 | B2 | 11/2010 | Jensen | |
| 7,823,816 | B2 * | 11/2010 | Jensen | B02C 18/0007 241/100 |
| 8,028,942 | B2 | 10/2011 | Matlin et al. | |
| 8,087,599 | B2 * | 1/2012 | Chen | B02C 18/0007 241/100 |
| 8,205,815 | B2 | 6/2012 | Cai et al. | |
| 8,336,792 | B2 | 12/2012 | Matlin et al. | |
| 8,727,255 | B2 * | 5/2014 | Kim | B02C 18/0007 241/100 |
| 8,931,721 | B2 * | 1/2015 | Jensen | B02C 18/0007 241/100 |
| 2012/0187230 | A1 | 7/2012 | Aries et al. | |

FOREIGN PATENT DOCUMENTS

KR 2005123006 A 12/2005

* cited by examiner

*Primary Examiner* — Faye Francis
(74) *Attorney, Agent, or Firm* — Sheridan Ross P.C.

(57) ABSTRACT

A shredder includes a housing having an opening for the insertion of media to be shredded. A cutting assembly for the shredding of media is disposed in the housing. A media detector including an infrared emitter and an infrared sensor is disposed about the opening for the detection of the presence of media to be shredded in the opening. A controller is disposed in the housing and is in responsive communication with the media detector for controlling the operation of the cutting assembly. The controller is programmed with a dynamic media detection threshold that is at least in part passed upon an emission sensed value and a background sensed value.

20 Claims, 10 Drawing Sheets

SHREDDER WITH MEDIA DETECTOR

CROSS-REFERENCE TO RELATED APPLICATIONS

This application claims priority to and the benefit of U.S. Provisional Application Ser. No. 61/647,859, filed May 16, 2012, and entitled "SHREDDER WITH MEDIA DETECTOR".

BACKGROUND

This invention relates in general to shredders.

Shredders typically include a housing with a cutting mechanism for shredding media, e.g. cutting paper, and typically include a container for collecting shredded media, e.g. cut paper. The housing generally defines an opening through which papers to be shredded may pass to the cutting mechanism. Typically, the papers are then shredded by the cutting mechanism and collected in the container.

Some paper shredders include a media detector which may provide input to a shredder control device to allow the shedder to run at only certain times, such as when the presence of papers to be shredded is detected in the opening in the housing. One type of media detector includes an infrared (IR) emitter and sensor opposite one another across the opening.

It is know that the effectiveness of such IR based detector systems may diminish over time, for example, because of degradation of the emitter or sensor or because of the buildup of foreign material, such as paper dust, on the emitter or sensor. One known way to adjust for this diminished effectiveness is to compare a sensed IR value with the emitter on and the opening unobstructed and compare that value to a stored desired value. The power to the emitter may then be increased until the sensed value matches the desired value and then the IR emitter is reset to operate at that new power value.

SUMMARY

This invention relates to a shredder with a media detector.

The shredder includes a housing having an opening for the insertion of media to be shredded. A cutting assembly for the shredding of media is disposed within the housing. A media detector including an infrared emitter and an infrared sensor is disposed about the opening for the detection of the presence of media to be shredded in the opening. A controller is disposed in the housing and is in responsive communication with the media detector for controlling the operation of the cutting assembly. The controller is programmed with a dynamic media detection threshold that is, at least in part, based upon an emission sensed value and a background sensed value.

Various aspects will become apparent to those skilled in the art from the following detailed description and the accompanying drawings.

DETAILED DESCRIPTION

While the term "paper shredder" generally refers to a device for shredding, e.g. cutting paper, it must be understood that as used herein the term "paper shredder" may include devices capable of shredding more than paper. For example, a "paper shredder" may be able to cut plastic articles, such as credit cards, CDs/DVDs, and the like.

Figure 1:
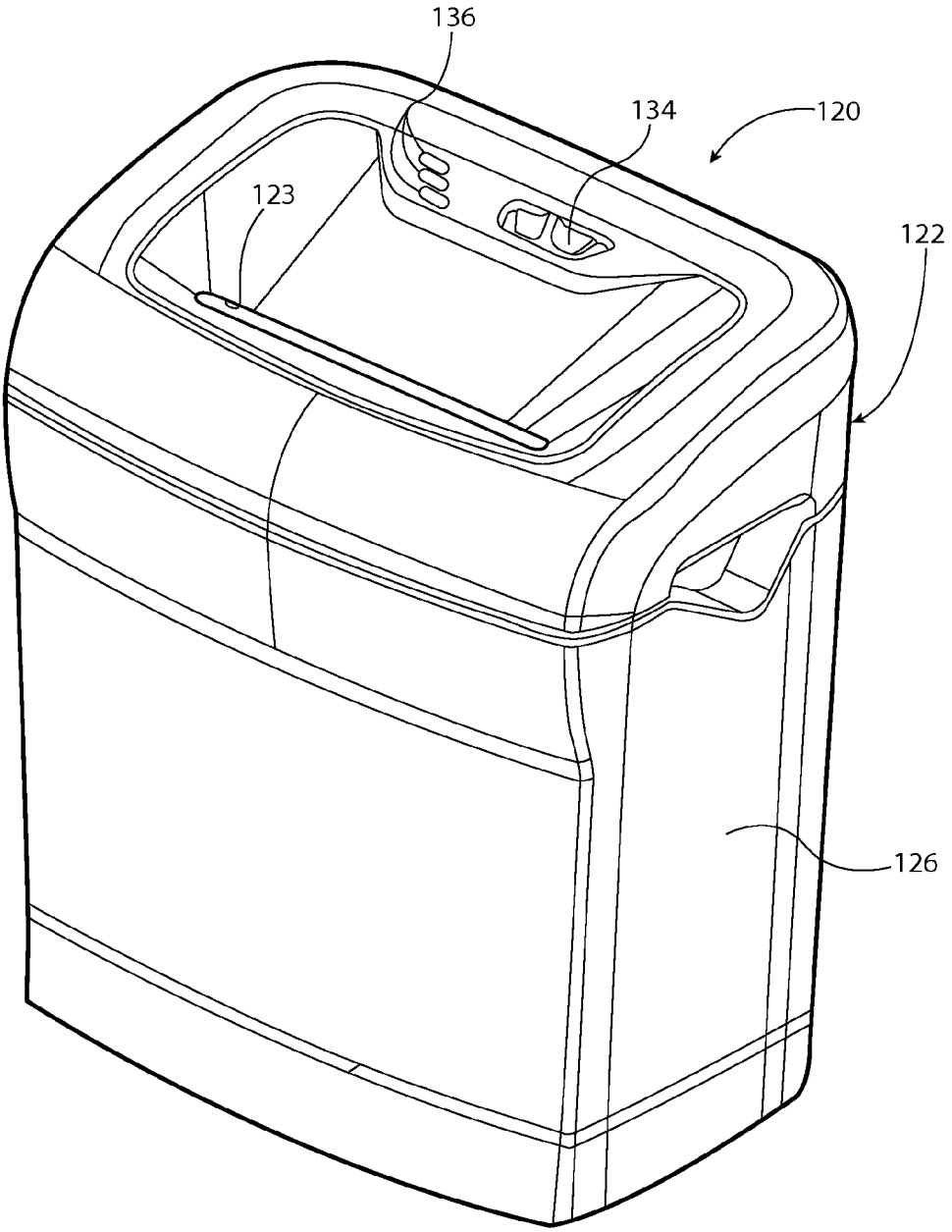
FIG. 1 is a perspective view of a shredder including a housing.
Figure 2:
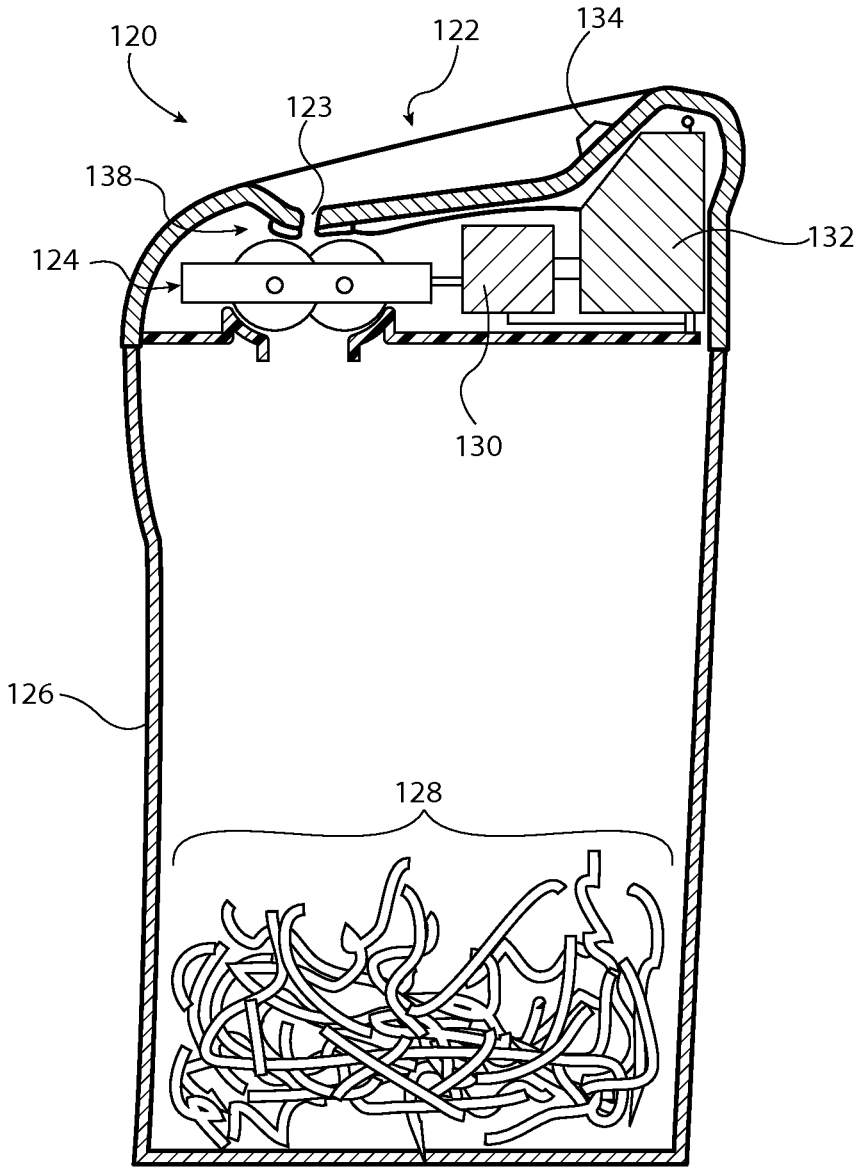
FIG. 2 is a cross sectional view of the shredder of FIG. 1.

Referring now to the drawings, there is illustrated in FIGS. 1 and 2 a media shredder 120, which may be used for shredding certain material, such as private, confidential or sensitive papers. The shredder 120 includes a shredder housing 122. The shredder housing 122 may, for example, be made of plastic, or other moldable material, sheet metal or any other suitable material. The shredder housing 122 defines an insertion opening 123 for the passage of material to be destroyed, for example paper, electronically readable media and the like. A cutting assembly 124 capable of shredding material passed through the insertion opening 123 is mounted in the shredder housing 122. The insertion opening 123 may be relatively narrow, as compared to the thickness of a large enough amount of material that would jam the shredder 120, thus as to reduce the likelihood of a jam in the cutting assembly 124.

The shredder 120 further includes a container, e.g. receptacle, 126 for collecting shredded material 128 which has been shredded by the cutting assembly 124. The container 126 may be optionally separable from the portion of the shredder housing 122 in which the cutting assembly 124 is mounted. The container 126 defines a top opening through which paper cut in the shredder housing 122 may pass from the cutting assembly 124 into the container 126. As illustrated, the portion of shredder housing 122 to which the cutting assembly 124 is mounted is directly engaging the container 126, either resting on or secured thereto, although such is not required. That portion of the shredder housing 122 may be secured, as desired, to the container 126, for example, by threaded fasteners, plastic clips, spring-loaded ball detent mechanism, or any other suitable manner. Additionally, the shredder housing 122 may engage the container 126 in a nested relation. Further, that portion of the shredder housing 122 and the container 126 may be formed as an integral unit. The shredder housing 122 may also include optional handles, either molded in or later attached, for ease of removing and placing the shredder housing 122.

A power supply 130 for providing power to drive the cutting assembly 124 is associated with the shredder housing 122. As illustrated, the power supply 130 is disposed in the shredder housing 122, although such is not required. The power supply 130 may provide electrical power to the cutting assembly 124 in the case where the cutting assembly 124 includes an electrically powered mechanical drive mechanism. Alternatively, the power supply 130 may provide mechanical power to the cutting assembly 124 in the case where the cutting assembly 124 is directly driven by mechanical power. In such a case, the power supply 130 may, for example, be an electrically powered motor. In any case, the power supply 130 may provide power in any suitable fashion to drive the cutting assembly 124.

A control unit 132 for controlling the cutting assembly 124 and/or the power supply 130 and thereby the cutting assembly 124, is also associated with the shredder housing 122. As illustrated, the control unit 132 is disposed in the shredder housing 122, although such is not required. A control device 134, such as a switch, for manual engagement by a user for selectively operating the shredder 120 is disposed on the exterior of the shredder housing 122 and is operatively connected to the control unit 132. It is also contemplated that the control unit 132 may also be operated by remote control or automated control. The control device 134 may function to select the mode of shredder operation, e.g. on/off, manual/automatic, etc. Additionally, the control unit 132 and control device 134 may be optionally configured to operate the shredder 120 in a reverse manner, such as to release any material that may be in the cutting assembly 124 without having to pass any further therethrough. It is also contemplated that the control device 134 may optionally include a safety lock feature which requires that a user may have to perform a specific operation, such as hold the control device 134 in a particular position for a predetermined amount of time, before the shredder 120 will activate.

A number of optional indicators 136 are also disposed on the exterior of the shredder housing 122. The indicators 136 may indicate any desired operational state of the shredder 120, such as power status, empty/full state of the container 126, the presence of a jam or activation of a safety shutoff or the like. It must be understood that the indicators 136 are optional features and need not necessarily be included in the shredder 120.

Figure 3:
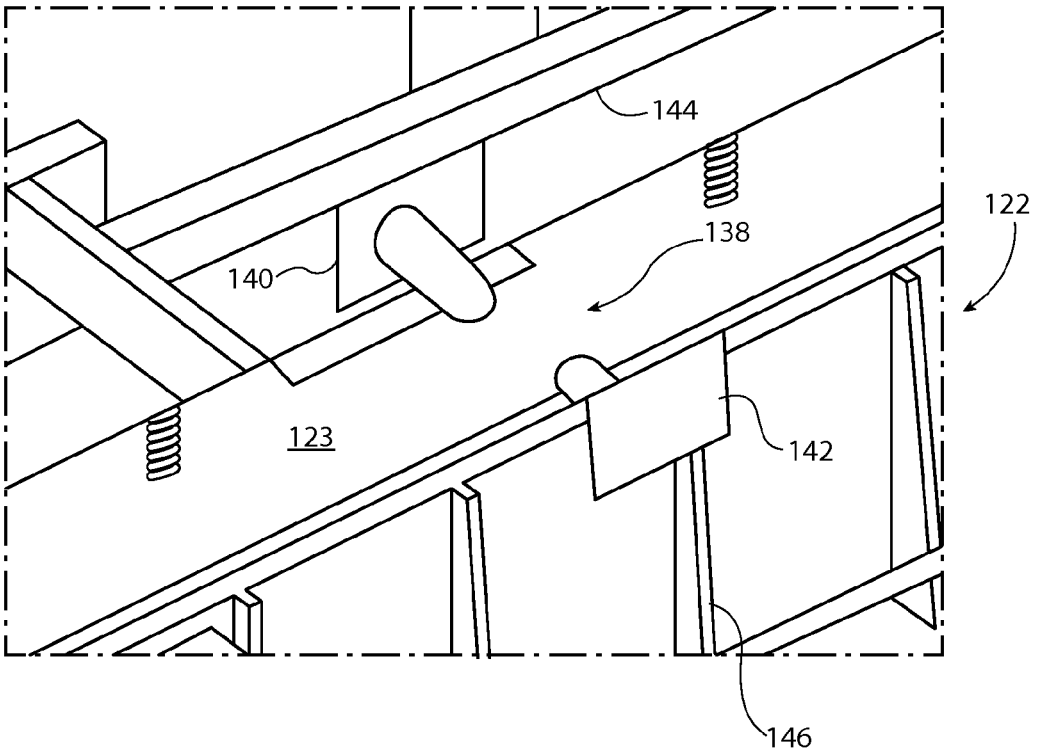
FIG. 3 is a bottom perspective view of a portion of the shredder shown in FIG. 2.
Figure 4:
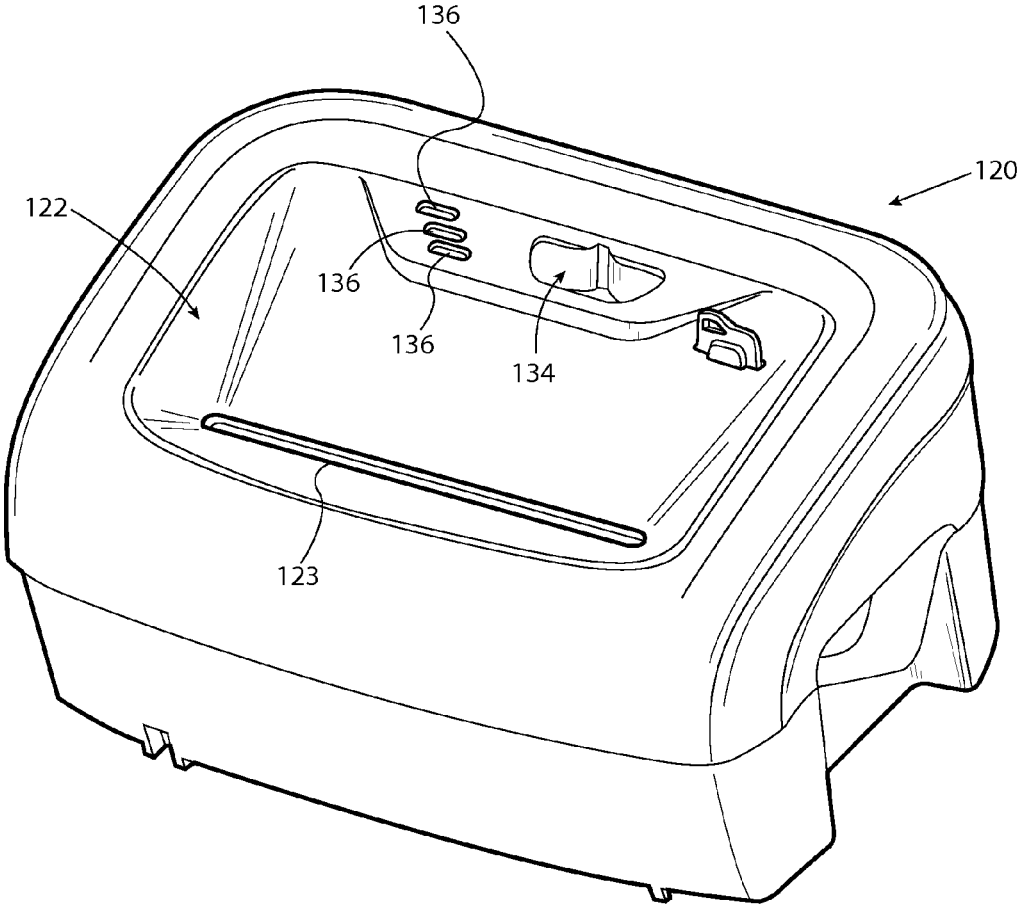
FIG. 4 is a perspective view of a portion of a shredder according to another embodiment.
Figure 5:
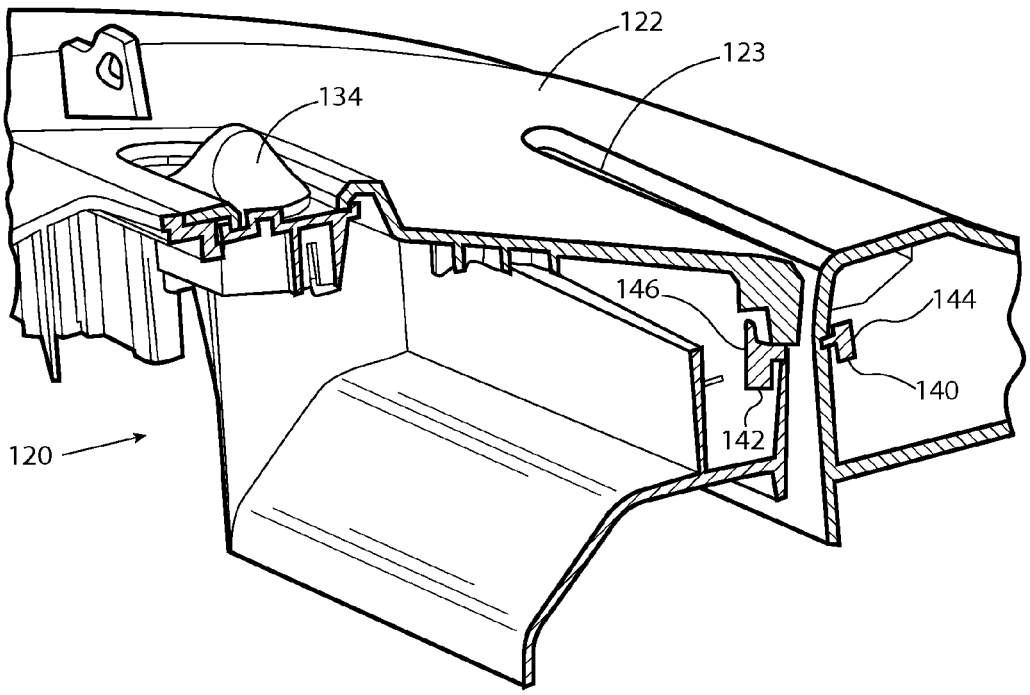
FIG. 5 is a side cross-sectional view in perspective of a portion of the top head of FIG. 4.
Figure 6:
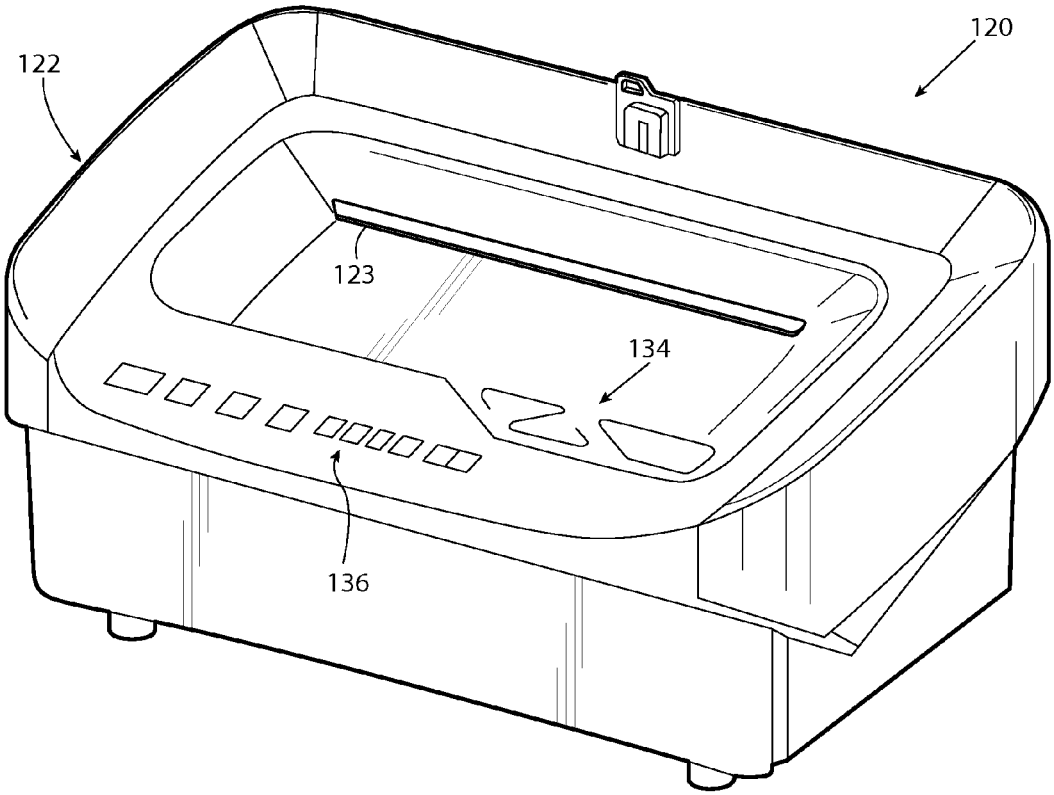
FIG. 6 is a perspective view of a portion of a shredder according to a further embodiment.
Figure 7:
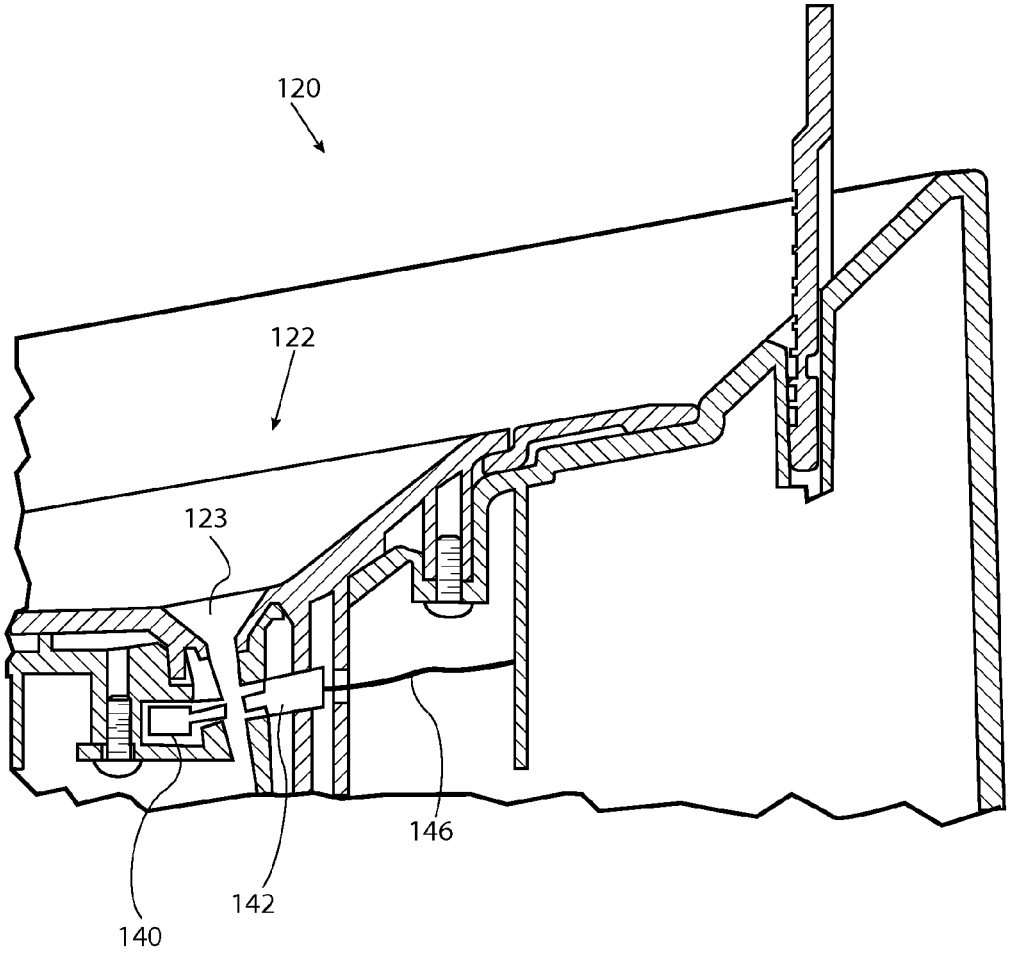
FIG. 7 is a partial side cross-sectional view of a portion of the shredder of FIG. 6.

As best shown in FIG. 3, the shredder 120 also includes a media detector 138. The media detector 138 includes an IR emitter 140 and an IR sensor 142. The emitter 140 and the sensor 142 are connected to the control unit 132 via communication lines 144 and 146 respectively. The communication lines 144 and 146 may be electrical wire, optical fibers, or any other suitable pathway to convey information between the detector 138 and the control unit 132. For further example the detector 138 and the control unit 132 may communicate wirelessly, by RF signaling such as Wi-Fi or Bluetooth, for example.

There are shown in FIGS. 4 and 5, and FIGS. 6 and 7 a shredder 120 according to another embodiment and a shredder 120 according to a further embodiment. Similar components are designated with similar identifiers.

Figure 8:
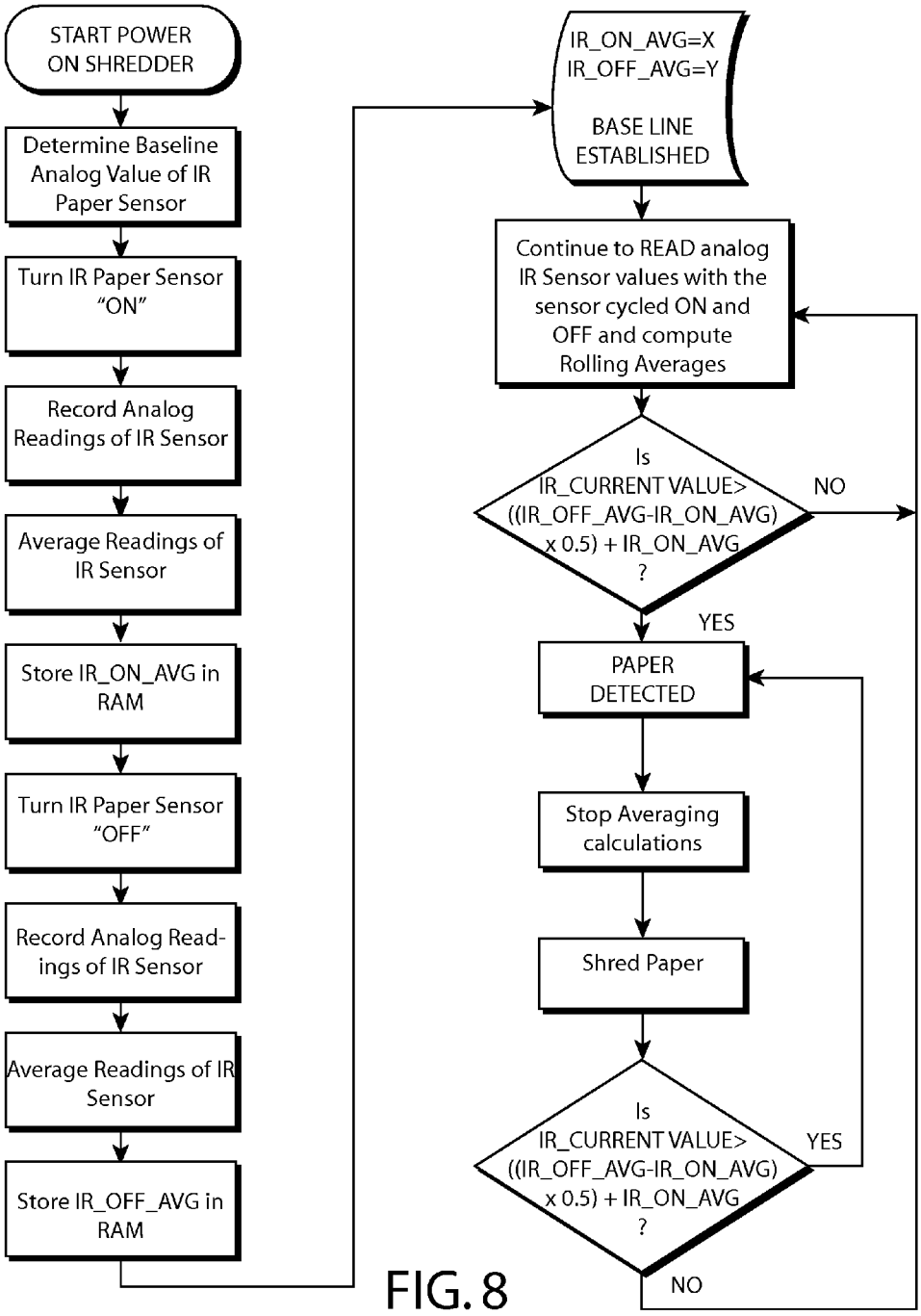
FIG. 8 is a flowchart of an algorithm for calibration of a media detector in a shredder.

FIG. 8 illustrates an algorithm for calibration of the media detector 138. This algorithm may, for example, be programmed into the control unit 132.

Operation of the algorithm is as follows:

Each time the shredder 120 is powered "ON", a baseline measurement of the IR pair, e.g. emitter 140 and sensor 142, is made and determined. This is the initial state of the IR pair that may take into account, among other things, dust build up on the emitter 140 or the sensor 142 and LED or other degradation in the IR emitter 140 or degradation in the IR sensor 142.

Multiple readings are taken both with and without the IR turned on, i.e. with and without the emitter 140 emitting. The averages for both conditions are recorded.

After a baseline is established, the unit continues to read the value of the media detector 138 with and without the IR turned on.

To determine if media, such as paper, is in the slot, the reading is compared to the value when the IR is turned on. If it exceeds this value by more than 50% of the difference between the average baseline readings without the IR turned on, then it is determined that media, e.g. paper, is in the slot.

In one use, when a paper, or other media, insertion condition is detected, the averages are no longer calculated. When the paper is removed, the averages may then be resumed.

The code that checks the paper sense is:

u16PaperReadAccumulator>((PAPER_RATIO_VARIANCE*(u16PaperReadRollingAvgNoIR–u16PaperReadRollingAvg))+u16PaperReadRollingAvg Thus, the average sensed emission with the IR turned on is subtracted from the average sensed background with the IR turned off. This is then multiplied by the PAPER_RATIO_VARIANCE. This is a floating point value, and, for example, the current code sets this to 0.5 (50%). This value is then added to the value of the average of the readings with the IR turned on. If the most recent reading is greater than this calculated value, then it is determined that media, e.g. paper, is in the slot.

Figure 9:
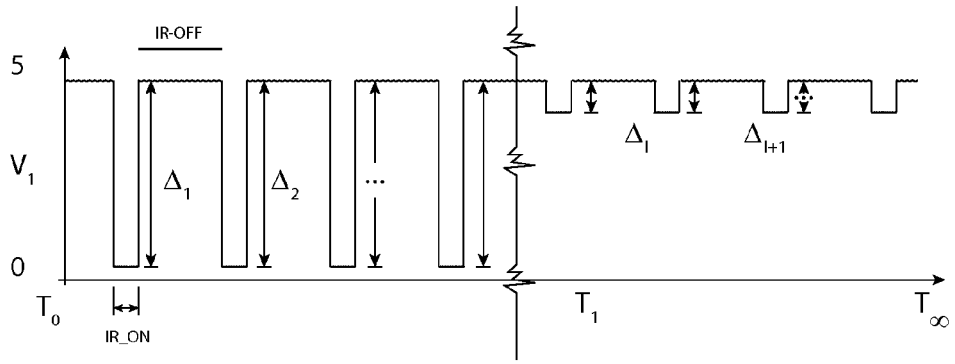
FIG. 9 is a graph showing detector degradation over time.

As shown in FIG. 9, over time the differential between the emission sensed value and the background sensed value diminishes. After time Ti, the detector 138 has, for example, accumulated some amount of paper dust on the emitter 140 or sensor 142 and or the emitter 140 or sensor 142 has degraded.

Figure 10:
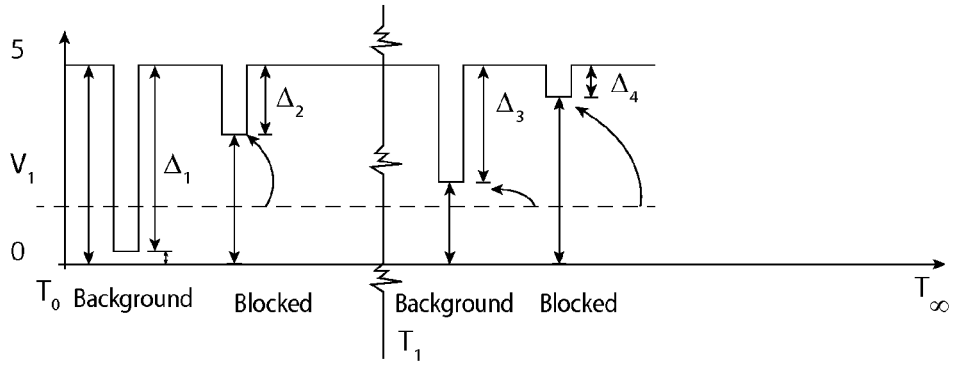
FIG. 10 is a graph showing the difference between background reading and blocked reading in a clean detector and a dusty detector.

As shown in FIG. 10, the threshold difference between background sensed value and media detected value has shifted after time Ti once the detector 138 has, for example accumulated some amount of paper dust on the emitter 140 or sensor 142 and or the emitter 140 or sensor 142 has degraded.

Figure 11:
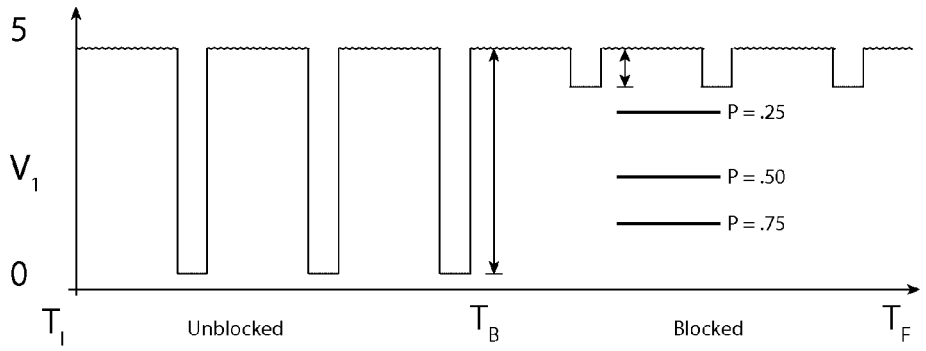
FIG. 11 is a graph showing calculated threshold levels for a clean and non-degraded detector.
Figure 12:
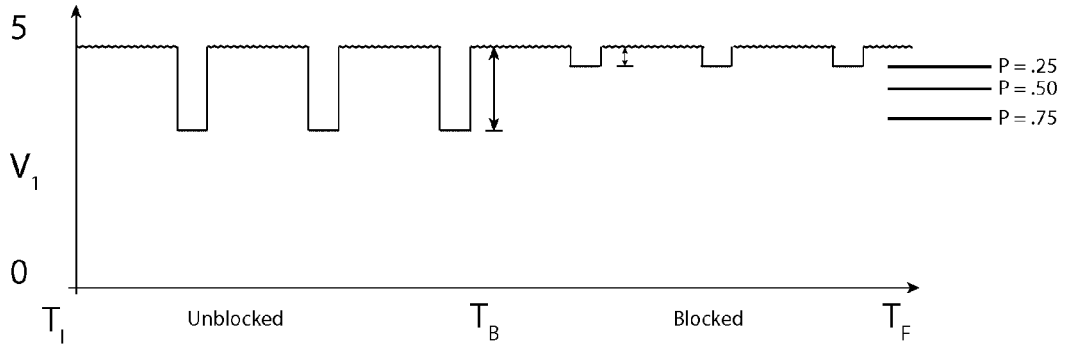
FIG. 12 is a graph showing calculated threshold levels for a dusty or degraded detector.

As shown in FIGS. 11 and 12 the calculated threshold levels, for example P=0.25, P=0.50 and P=0.75, shift between a clean and non-degraded detector 138, see FIG. 11, and a dusty or degraded detector 138, see FIG. 12. The graphs in FIGS. 11 and 12 illustrate the emission sensed value and background sensed value before time TB and the emission sensed value and the media detected value after time TB.

Thus, the threshold value for detection of media to be shredded may be updated and the controller may be responsive to the signal from the detector 138 based upon this new threshold value.

While principles and modes of operation have been explained and illustrated with regard to particular embodiments, it must be understood, however, that this may be practiced otherwise than as specifically explained and illustrated without departing from its spirit or scope.

What is claimed is:

1. A shredder comprising:

a housing having an opening for the insertion of media to be shredded;

a cutting assembly for the shredding of media disposed in the housing;

a media detector including an infrared emitter and an infrared sensor disposed about the opening for the detection of the presence of media to be shredded in the opening, wherein the infrared sensor is configured to sense a background power value when the infrared emitter is not emitting infrared and sense an emission power value when the infrared emitter is emitting infrared; and a controller disposed within the housing and in responsive communication with the media detector for controlling the operation of the cutting assembly, wherein the controller is programmed with a dynamic media detection threshold that is at least in part based upon the sensed emission power value and the sensed background power value.

2. The shredder of claim 1, wherein the controller is in responsive communication with the media detector via communication lines.

3. The shredder of claim 2, wherein the communication lines include at least one of electrical wire or optical fiber.

4. The shredder of claim 1, wherein the controller is in responsive communication with the media detector via wireless communication.

5. The shredder of claim 4, wherein the wireless communication includes at least one of Wi-Fi or Bluetooth.

6. The shredder of claim 1, further comprising:

a control device connected to the controller for selective operation of the shredder.

7. The shredder of claim 6, wherein the control device is a manual switch.

8. A method for determining a media detection threshold value comprising:

providing a shredder including:

a housing having an opening for the insertion of media to be shredded;

a cutting assembly for the shredding of media disposed in the housing;

a media detector including an infrared emitter and an infrared sensor disposed about the opening for the detection of the presence of media to be shredded in the opening, wherein the infrared sensor is configured to sense a background power value when the infrared emitter is not emitting infrared and sense an emission power value when the infrared emitter is emitting infrared; and a controller disposed the housing and in responsive communication with the media detector for controlling the operation of the cutting assembly;

determining, via the controller, a baseline emission power value based on the emission power value sensed when the infrared emitter is emitting infrared;

determining, via the controller, a baseline background power value based on the background power value sensed when the infrared emitter is not emitting infrared; and determining a media detection threshold that is at least in part based upon the baseline emission power value and the baseline background power value.

9. The method of claim 8, wherein determining the baseline emission power value occurs when the shredder is powered on.

10. The method of claim 8, wherein determining the baseline emission power value includes averaging multiple readings for emission sensed when the infrared emitter is emitting infrared.

11. The method of claim 8, wherein determining the baseline background power value includes averaging multiple readings for background sensed when the infrared emitter is not emitting infrared.

12. The method of claim 8, wherein the media detection threshold is a power value greater than approximately 50% of the difference between the sensed emission power value and the sensed background power value.

13. The method of claim 8, wherein after the media detection value is determined, the method further comprises:

determining, via the controller, a subsequent baseline emission power value based on the emission power value sensed when the infrared emitter is emitting infrared.

14. The method of claim 8, wherein after the media detection value is determined, the method further comprises:

determining, via the controller, a subsequent baseline background power value based on the background power value sensed when the infrared emitter is not emitting infrared.

15. The method of claim 8, wherein the media detection threshold is the sensed emission power value subtracted from the sensed background power value multiplied by a paper ratio variance.

16. The method of claim 15, wherein the paper ratio variance is a floating point value.

17. The method of claim 15, wherein the paper ratio variance is approximately 0.5.

18. A shredder comprising:

a housing having an opening for the insertion of media to be shredded;

a cutting assembly for the shredding of media disposed in the housing;

a media detector including an infrared emitter and an infrared sensor disposed about the opening for the detection of the presence of media to be shredded in the opening, wherein the infrared sensor is configured to sense a background power value when the infrared emitter is not emitting infrared and sense an emission power value when the infrared emitter is emitting infrared; and a means for controlling the operation of the cutting assembly disposed within the housing and in responsive communication with the media detector, where the means for controlling is programmed with a dynamic media detection threshold that is at least in part based upon the sensed emission power value and the sensed background power value.

19. The shredder of claim 18, wherein the dynamic media detection threshold is the sensed emission power value subtracted from the sensed background power value multiplied by a paper ratio variance.

20. The shredder of claim 18, further comprising:

a control device connected to the means for controlling for selective operation of the shredder.

* * * * *